United States Patent [19]

Korte

[11] 4,371,104

[45] Feb. 1, 1983

[54] DISPENSER BOX WITH CUTTING EDGE

[75] Inventor: Ralph J. Korte, Darien, Ill.

[73] Assignee: Champion International Corporation, Stamford, Conn.

[21] Appl. No.: 270,486

[22] Filed: Jun. 4, 1981

Related U.S. Application Data

[63] Continuation-in-part of Ser. No. 227,685, Jan. 23, 1981, abandoned.

[51] Int. Cl.[3] ..... B26D 1/02

[52] U.S. Cl. ..... 225/48; 225/91

[58] Field of Search ..... 225/48–50, 225/91

[56] References Cited

U.S. PATENT DOCUMENTS

| | | | |
|---|---|---|---|
| 1,887,912 | 11/1932 | Begle | 225/49 |
| 2,628,179 | 2/1953 | Bergstein | 225/48 X |
| 2,633,985 | 4/1953 | Meyer | 225/49 X |
| 3,137,424 | 6/1964 | Finn et al. | 225/48 |
| 3,193,427 | 7/1965 | Rogers | 225/49 X |
| 3,933,288 | 1/1976 | Struble | 225/48 X |
| 3,974,947 | 8/1976 | Budny | 225/49 X |

*Primary Examiner*—Frank T. Yost

*Attorney, Agent, or Firm*—Evelyn M. Sommer

[57] ABSTRACT

A dispensing carton for a web in roll form wherein the lid is closed on the roll with an end of the web emerging between the lid and the wall of the carton. The wall of the carton is provided with a longitudinal relatively stiff strip, preferably of plastic, adjacent the opening in the carton through which the web is drawn. The strip has a serrated edge for tearing the web after a desired length is drawn. The strip is extended onto adjacent sealing or dust flaps of the carton which are secured to the end walls of the carton so that when the sealing or dust flaps are folded into engagement with the end walls of the carton during manufacture of the carton, reinforced corners for the carton are formed at the areas of greatest stress where the web is first torn against the serrated edge, or reinforcement is obtained by using a multi-ply underlay for supporting serrated edge strip. The serrated edge strip may be mounted to extend beyond a side wall or a bottom wall of the carton. The invention also includes the method of making the carton having a serrated web in which a pair of cartons are juxtaposed or a single blank is die cut in the form of a pair of cartons. A strip is laid at the seam or that area between the cartons which is to form the upper edge of the wall adjacent the opening in the finished cartons and the blanks for the two cartons and the strip are cut apart by a member which forms matching serrated edges as well as the reinforcements above described. The two cartons thus separated may then be separately formed by appropriate machinery and filled with the roll of material to be kept in the carton and withdrawn therefrom.

6 Claims, 18 Drawing Figures

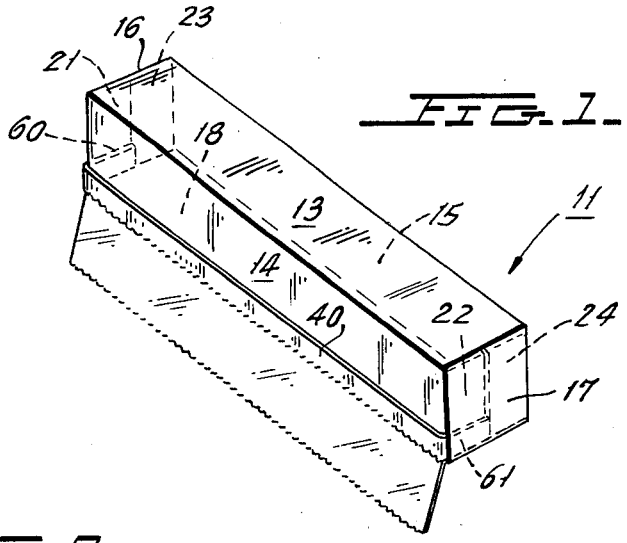
FIG. 1
FIG. 3
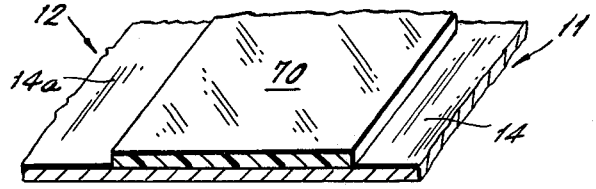
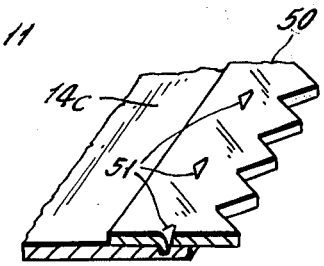
FIG. 7
(PRIOR ART)
FIG. 5
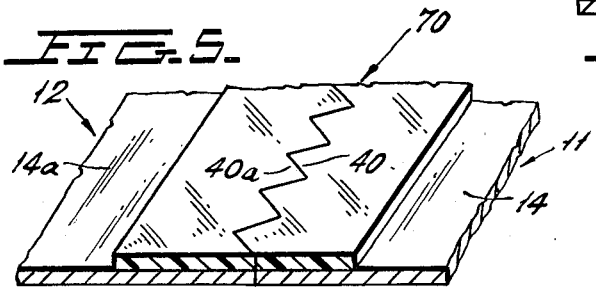
FIG. 6
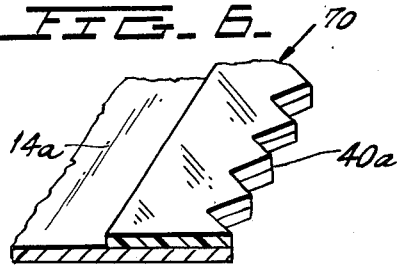
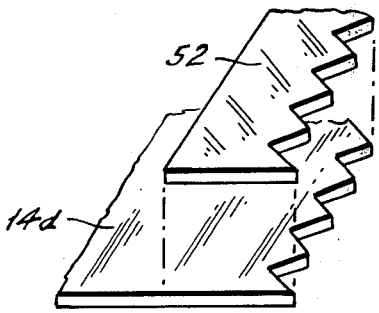
FIG. 8
(PRIOR ART)

FIG. 15
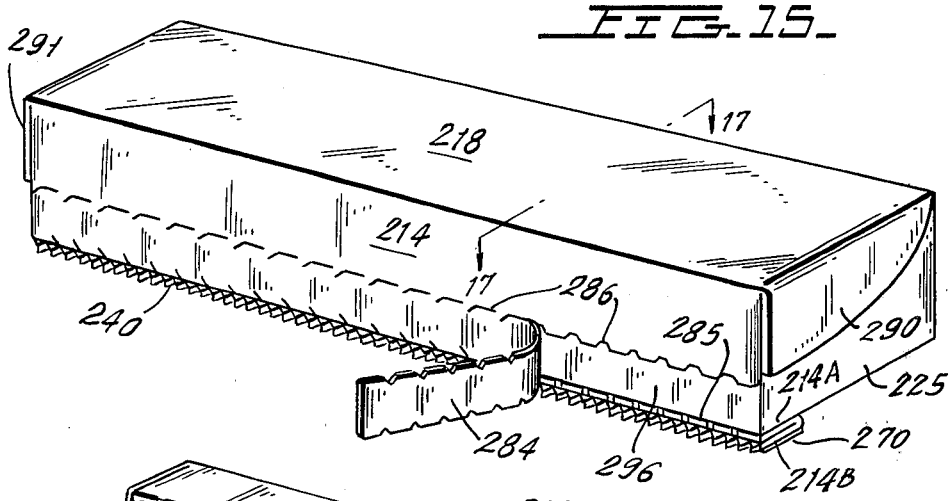
FIG. 16
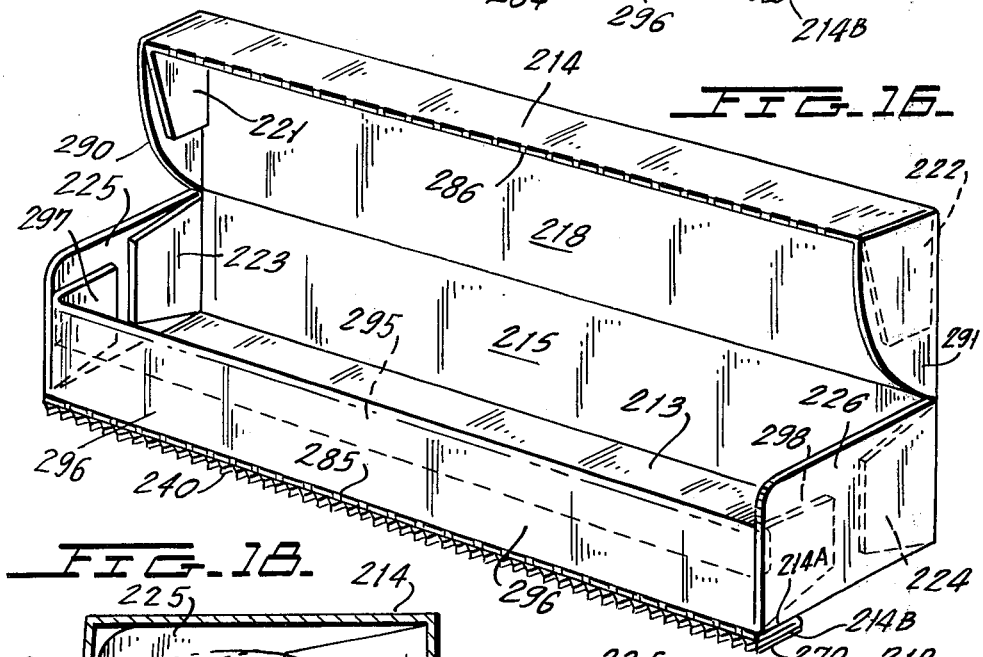
FIG. 18
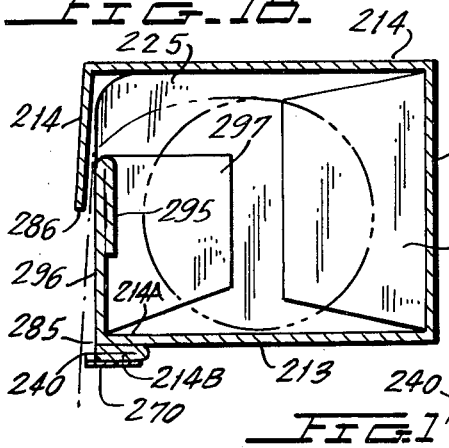
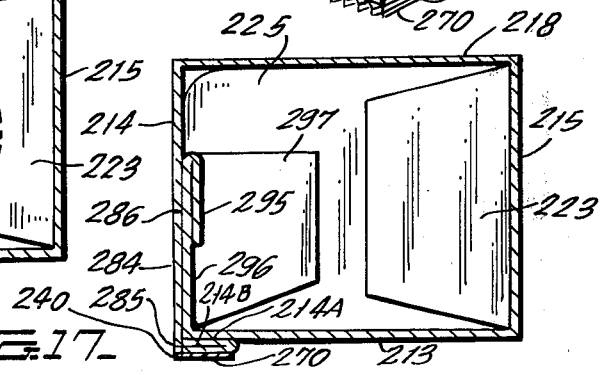
FIG. 17

DISPENSER BOX WITH CUTTING EDGE

This application is a continuation-in-part of application Ser. No. 227,685, filed Jan. 23, 1981, now abandoned.

The present invention relates to a box or carton for retaining and dispensing sheets of desired length from a roll contained within the carton and basically relates to the method of construction and operation of the tear off element or cutting edge which permits a sheet of the desired length to be torn off after it has been pulled out from the roll in the carton.

Such dispensing cartons usually comprise an elongated quadralateral structure having a bottom wall, a pair of parallel side walls, a pair of end walls, and a hinged lid which folds down to form what may be regarded as the top wall. Adjacent the edge of the wall of the carton at which the material may be pulled out from the roll, a serrated metal structure has previously been applied so that after the web has been drawn out to the desired length the web may be pulled down against the serrated edge and severed.

In the usual method of manufacturing such a dispensing carton or box having means for tearing off a desired length of the web, a metal strip is applied in a separate operation to the completed blank on a machine which is referred to as a Fuastel Metal Edger. Since the usual operation for tearing off the web is to exert force initially at one end of the serrated edge and pull the web across the metal edge so that the web is severed by a successive cutting action rather than a simultaneous cutting action, great stress is placed on the corner of the box adjacent both ends of the applied metal serrated structure. After a period of use and before the web is completely used up from the roll, the tendency is for the corners of the carton, which is usually made of paperboard, to give way and flex to an almost inoperative position binding the roll or tearing so that the roll is not fully contained.

The primary object of the present invention is the provision of a serrated edge of a plastic strip which will be applied to the same section of the carton, but will extend beyond the cutting edge of the carton to the dust flap on the side of the carton and thus not only provide a serrated edge for cutting the web which is drawn from the roll in the carton but also provide, inherently, reinforcement for the carton structure thereby preventing the warping, distortion or tearing which heretofore has occurred in connection with unreinforced cartons.

In addition, as a further object of the present invention, contemplated by the present invention, is that the serrated plastic strip need not be applied on a separate machine, but may be applied in the formation of the carton. The strip is applied between adjacent carton blanks or along a line on a single blank for forming two cartons, as a non-serrated continuous strip which is adhered to the carton by any suitable means such as pressure sensitive adhesive which will lend itself to continuous feeding of the plastic strip to the blanks or by appropriate adhesive that is applied to the plastic strip as it is presented to the blanks. The die which thereafter cuts the adjacent blanks apart may be provided with appropriate serration-forming conformations so that the single unserrated plastic strip applied between adjacent edges of adjacent blanks will be cut apart to cut the blank apart, provide the serrated edge for the plastic strip on each of the blanks, and provide also the additional reinforcing element on the minor dust flap which will serve to additionally integrate and reinforce the carton sides and front so that no deformation or tearing of the carton will occur during the expected use of the carton. The same die may be used to form the blanks at the same time that they are cut apart.

The foregoing and many other objects of the present invention will become apparent in the following description and drawings in which:

FIG. 1 is a view in perspective of a carton having the serrated plastic strip of the present invention.

FIG. 3 is an enlarged view in perspective of the plastic strip as secured to adjacent carton blanks which are integrated with each other.

FIG. 5 is a view in perspective showing the condition of the seam between the carton blanks after the die cutting operation.

FIG. 6 is a corresponding view in perspective showing the carton blanks separated.

FIGS. 7 and 8 are views in perspective showing prior art structures, the problem of which are overcome by the structure of the present invention.

FIG. 15 is a view in perspective of a carton for encasing a roll of material, formed from the blank of FIG. 14, in closed position with the seal partially opened.

FIG. 16 is a view in perspective of the carton of FIG. 15 opened.

FIG. 17 is a cross-sectional view taken on line 17—17 of FIG. 15 looking in the direction of the arrows.

FIG. 18 is a view from the interior of the carton of FIG. 16, partially closed.

Figure 2:
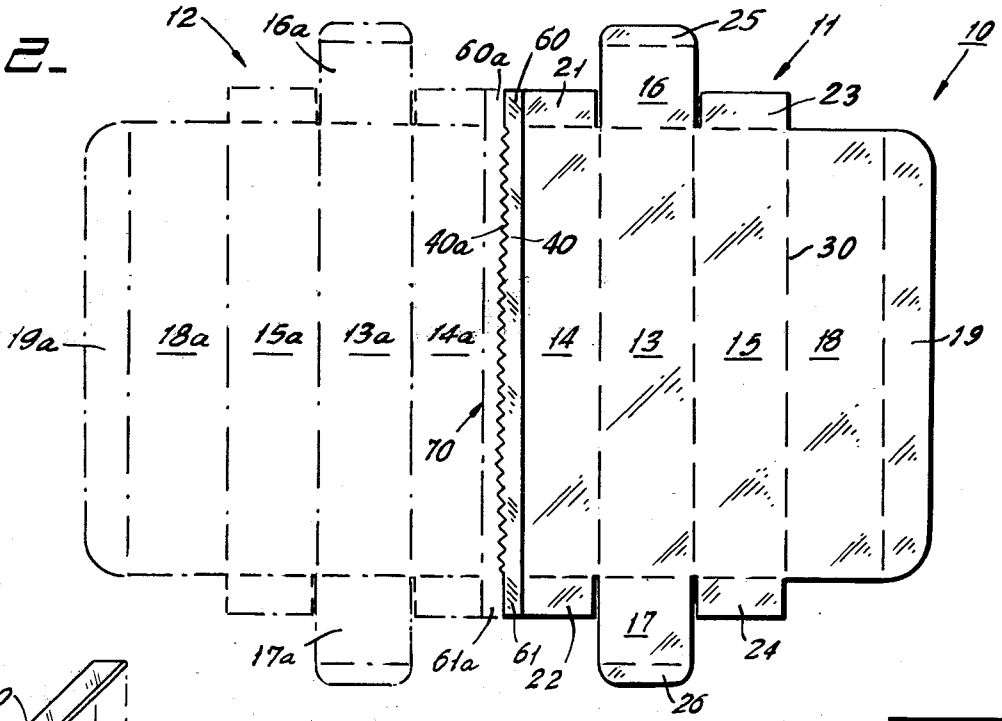
FIG. 2 is a plan view of a pair of carton blanks which have either been placed adjacent to each other or are integrated with each other along a common boundary with the plastic strip of the present invention secured thereto.

Referring now to the Figures, the carton or box shown in FIG. 1 is made from the carton blank of FIG. 2, wherein a single die cut blank 10 may consist of separate sections 11 and 12 for two separate cartons.

In the following, the term bottom wall and top wall and side walls and the reference to the fact that a lid is at the top wall are used interchangeably in the sense that the carton may be held or mounted in any orientation during use. Some users prefer to pull the web out upwardly and then tear down against the serrated edge. Other users prefer to pull the web out downwardly and then pull it up against the serrated edge. The latter holding or mounting of the carton is shown in FIG. 1. But, usually the carton is intended to be hand-held and not attached permanently to any surface so that a plurality of such cartons containing various different materials such as aluminum foil, wax paper, various types of sealing paper and other easily tearable webs may be used interchangeably by storing various cartons containing the same.

Section 11 of the blank 10 consists of the bottom wall 13, the side walls 14, 15, and the end walls 16, 17, the top wall or lid 18 and the openable sealing flap 19. The side walls 14 and 15 have respectively the sealing flaps 21, 22, 23 and 24. These sealing flaps may be brought into juxtaposition with the end walls 16 and 17, preferably on the interior of the carton, and sealed thereto to provide dust excluding flaps and to provide a means for erecting the carton and properly encasing the roll within the carton. They are hereinafter variously referred to as sealing flaps or dust excluding flaps.

The end walls 16 and 17 also have additional flaps 25, 26, respectively, which may be folded in over the roll of sheet material after it is placed in the carton.

In order to assist in retaining the roll in position during the opening operation, the lid 18 is hingedly secured along the fold line 30 to the side wall 15 and is closed over the roll in the carton. The sealing flap 19 on the lid may either be inserted in the carton and releasably sealed to the inside wall or may, if desired, be folded over the serrated edge 40 at the top of the wall 14 of the carton 11 by releasable sealing means which the purchaser of the carton may readily open.

Thereafter, following instructions, after the leading edge of the web within the carton has been pulled out over the serrated edge 40 and the top end of the end walls 16, 17 the flap 19 may be folded into the carton on the inside of the wall 14 so that the roll of web material therein is fully encased and a slot is formed between the sealing flap 19 now adjacent the inner surface of wall 14 through which the web is drawn so that it may be pulled against the serrated edge 40.

The prior art as shown in FIGS. 7 and 8 has utilized a serrated structure 50 which was secured to a wall 14*c* by any suitable securing means such as the integral knock-outs 52 (FIG. 7). Or, as shown in FIG. 8, a serrated structure 52 has been used which was secured to the wall 14*d* by adhesive or otherwise integrated with the wall 14*d* and thereafter die cut or otherwise treated to cut both the structure 52 and the wall 14*d*.

The carton blank 12 has been given identical reference numerals for the same parts as the carton 11 of FIG. 2 with the addition of the letter a.

Reference should now be made to FIGS. 2, 3, 4 and 5 for successive operations by which the structure of the present invention is formed paying particular attention not only to the serrated member 40, but also to the extensions 60, 61 of the serrated member 40 on the flaps 21, 22 of carton 11 and flaps 21*a*, 22*a* of carton 12 of FIG. 2.

If the cartons are formed as individual blanks then they are placed together in the manner shown in FIG. 2. Preferably, the two cartons 11 and 12 should be formed as a single blank unit and die cut into blanks at the same time that the plastic strip is cut by a serrated portion of the cutting die. A plastic strip 70 is applied at the juncture between cartons 11 and 12 and secured in any suitable manner by adhesive which is applied prior to the application of the plastic strip or by the utilization of pressure sensitive adhesive on the portion of cartons 11–12 which is to receive the plastic strip or the undersurface of the plastic strip.

Figure 4:
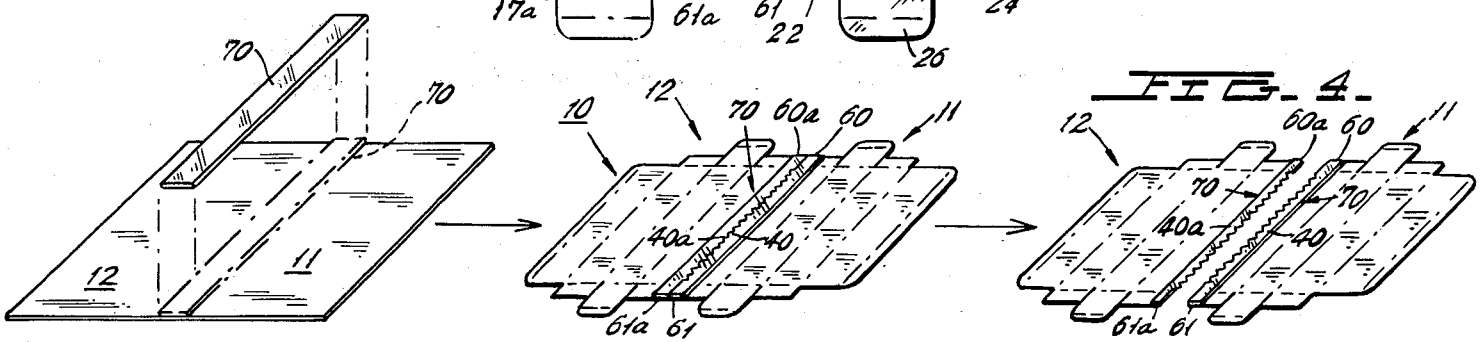
FIG. 4 is a set of successive views showing the operation by which the integrated or apposed carton blanks are connected by the plastic strip and cut apart by appropriate mechanism.
Figure 14:
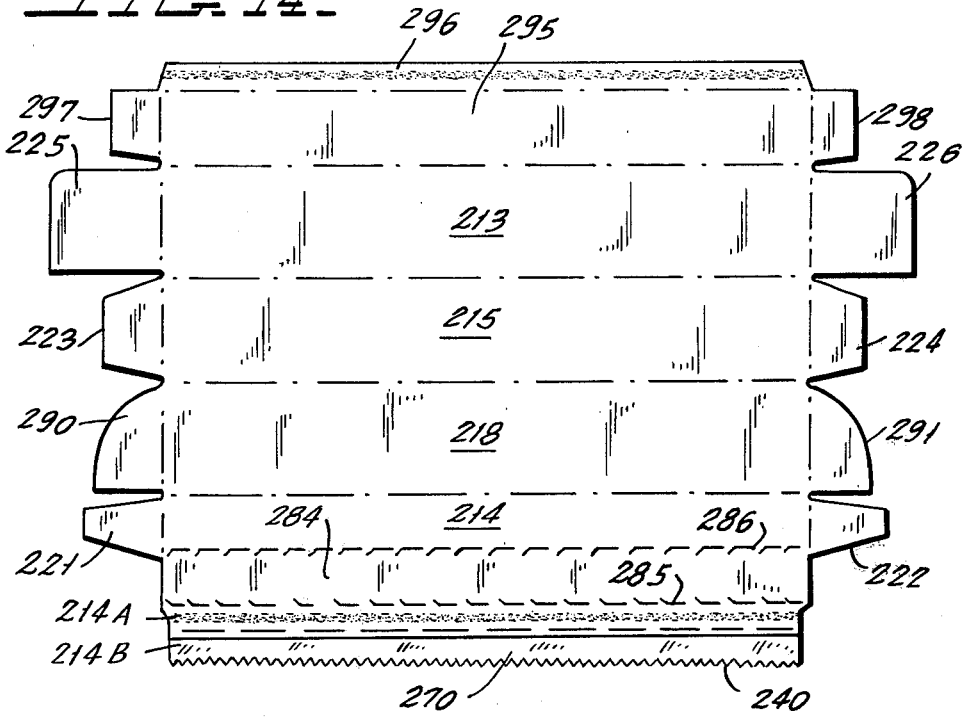
FIG. 14 is a plan view of a modified form of blank utilizing the principle of the present invention.
Figure 9:
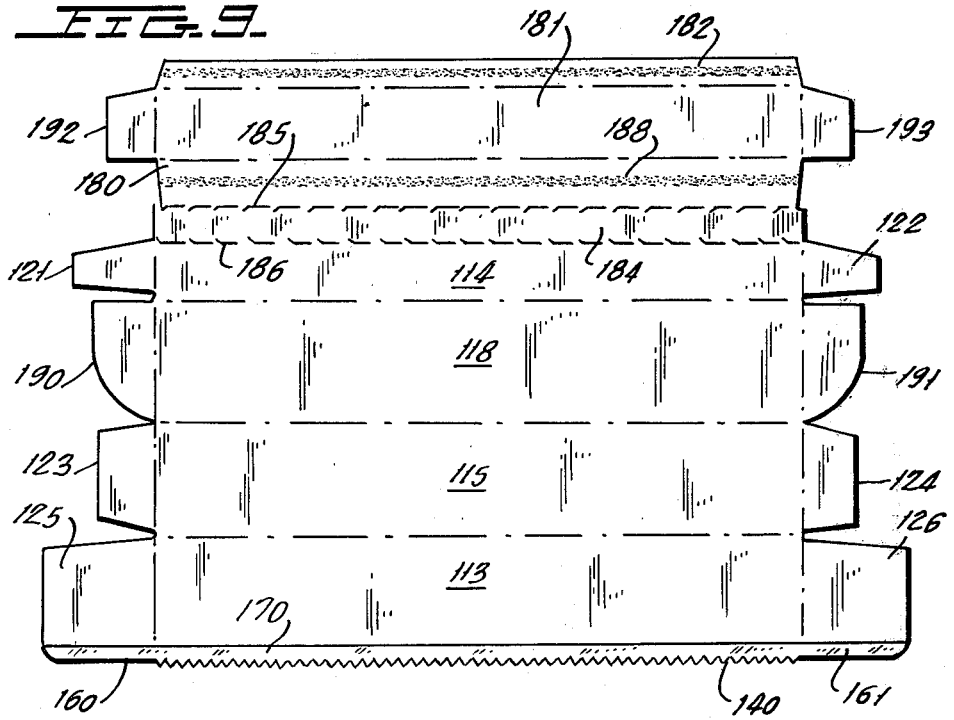
FIG. 9 is a plan view of a modified form of blank utilizing the principle of the present invention.

Once the plastic strip 70 is applied as shown in FIGS. 3 and 4, an appropriate die cutting operation is utilized as shown in the center Figure of FIG. 4 and in FIG. 5 to cut the plastic strips and the two blanks apart providing the serrated edge 40 on each of the cartons 11 and 12 and providing also for the extensions 60, 61 and 60*a*, 61*a* of the plastic strip onto the dust excluding sealing flaps 21–22 and the corresponding flaps 21*a*–22*a*.

The cut having been made as seen in the center Figure of FIG. 4 and in FIG. 5, the blanks are now separated as shown in the right-hand section of FIG. 4 and in FIG. 6. The serrated edge has now been applied to the top edges of both the wall 14 or 14*a*, and the blanks are separated in order to be formed on appropriate carton forming machines into the erected carton of FIG. 1. The lid 18 and its flap 19 are left open for insertion of the roll of web material. The roll of web material is inserted so that an edge thereto is adjacent the edge of the top wall 14 and roll retaining flaps 25, 26 are folded down and the sealing flap 19 is sealed so that it may readily be opened by the user as previously described.

One of the essential elements of the present invention is not merely the simplified method of forming and applying the serrated and cutting edge to the carton but also the fact that the plastic strip 70 extends beyond the top edge of wall 14 of carton 11 and of wall 14*a* of carton 12 to form the extensions 60–61 for the dust flaps 21, 22 and the extensions 60*a*, 61*a* for the dust flaps 21*a*, 22*a*.

This means, therefore, that the pair of cartons are formed into a pair of structures which may, as previously described, be readily erected, filled with the roll, closed and shipped for distribution. When the carton is opened by the user, the end of the roll of film is pulled out by the user and the lid 18 is closed preferably with the flap 19 inside the wall 14 and inside the end of the web. The lid 18, the flap 19, the flaps 25, 26 as well as lid 18 retain the roll in position while it is drawn out and the end of the film may be drawn out to the desired length and then torn against the serrated edge 40.

One of the essential elements of the present invention in addition to the method of making the same and the utilization of plastic rather than metal material for the serrated tear-off structure is the utilization of the extensions 60, 61 onto the sealing or dust excluding flaps 21, 22 so that the corners of the carton adjacent the tear off or serrated edge are further especially reinforced to resist deformation or tearing of the corners during use and before the roll is used up in the carton.

In the foregoing description related to FIGS. 1 through 6, the structure has been described in connection with the serrated tear-off strip along a side wall and directed toward a bottom wall. In FIGS. 9 through 13, there is shown a form which may, under certain circumstances, be preferred wherein the serrated tear-off strip is provided at the bottom wall so that the material which is withdrawn through the slot created by the removal of the sealing strip on a side wall may then be drawn down and cut off against the serrated edge on the bottom wall. In the case of FIGS. 9 through 13 as well as the later FIGS. 14 through 18 a distinction must be made between the serrated plastic tear-off or cut-off strip which is used to cut off the material and the removable sealing strip 184 in FIGS. 9 to 13 and 284 in FIGS. 14 to 18, which is manipulated by the user to open the sealed carton.

In FIGS. 9 through 13, the reference numbers applied correspond substantially to the reference numbers of FIGS. 1 to 6 with 100 added and the differences, if any, are pointed out in the course of the following description.

In FIGS. 14 through 18, a similar method has been used to indicate parallelism between the structures shown in FIGS. 14 through 18 and the structures shown in FIGS. 1 through 6 and 9 through 13 by utilizing the same reference numbers for corresponding elements with the number 200 added.

Figure 10:
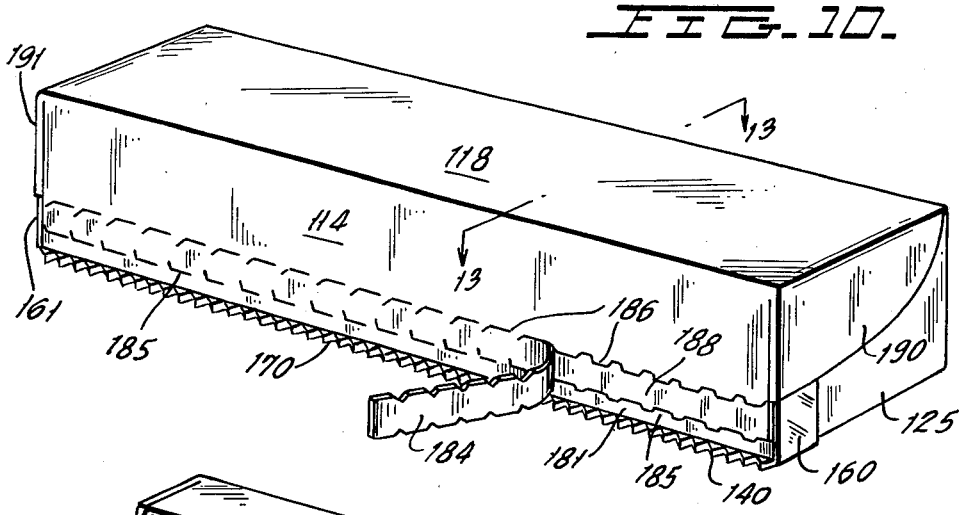
FIG. 10 is a view in perspective of a carton for encasing a roll of material, formed from the blank of FIG. 9, and shown in closed position with the seal partially opened.
Figure 11:
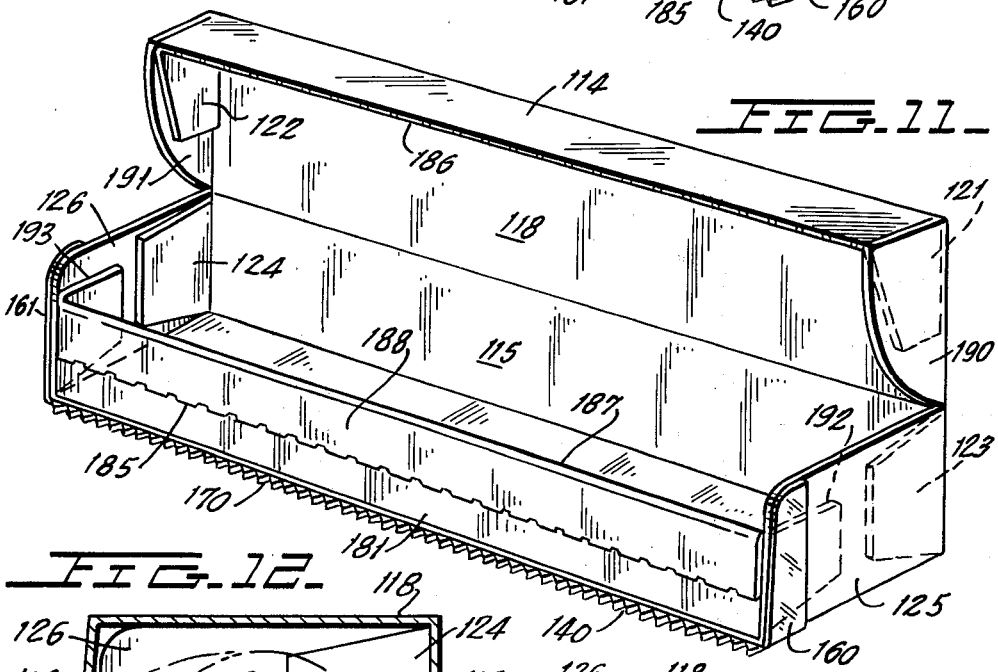
FIG. 11 is a view in perspective of the carton of FIG. 10 opened.

Referring first to FIGS. 9 through 13, the novel dispensing carton of this preferred sealed box which may be opened by the user by means of the tear-off strip 184, comprises a bottom wall 113, a side wall 115 foldably connected thereto and a top wall 118 foldably connected to the side wall 115. The side wall 114, however, differs substantially from the side wall 14 of FIGS. 1 to 6 in that this side wall 114 is provided with the opening strip 184 connected by tear lines 185, 186 into the body of the side wall 114. The tear lines 185, 186 permit the purchaser of the box which is sealed at the time of purchase to pull off the strip 184 as shown in FIGS. 10 and 11 and thereby open the box so that the top wall 118 may be lifted up and rotated about its hinged connection with the side wall 115 lifting up the remaining portion of the side wall 114 adjacent the tear-off line 186, thereby permitting access to the interior of the box as shown in FIGS. 10 and 11.

Figure 12:
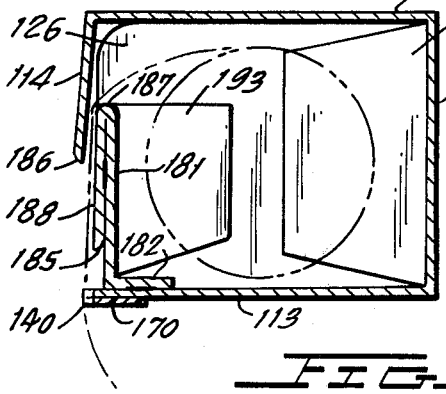
FIG. 12 is a cross-sectional view taken on line 12—12 of FIG. 10 looking in the direction of the arrows.
Figure 13:
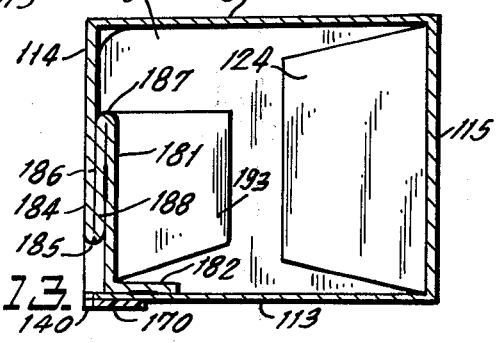
FIG. 13 is a view from the interior of the carton of FIG. 11.

The side wall 114 is reentrantly folded back on itself along the tear line 185 so that as seen in FIGS. 12 and 13 section 180 of the side wall is folded back into surface-to-surface relation with the back of the tear-off strip 184 and the principal portion 114 of the side wall. Panel 181 is then folded down on the fold line 187 so that the panel 181 is in surface-to-surface relation with panel 180 and is secured thereto by the adhesive strip 188, also as shown in FIGS. 12 and 13. Panel 182 hingedly extending from panel 181 is then secured adhesively to the bottom wall 113 at the edge thereof which extends adjacent the opening created by removal of strip 184 and, therefore, adjacent the tear line 185. The serrated cut-off strip 140 is adhesively secured to the outside of the bottom wall 113 at the edge thereof which extends adjacent the tear-off strip 184 with the serrations thereof projecting beyond the wall 113.

Consequently, when the user obtains the completed structure with the roll of material enclosed therewith, he first rips off the tear-off strip 184, as shown in FIGS. 10 and 11, opening the carton. He pulls out the edge of the roll so that it extends past fold line 187 of the original blank, pulling the edge of the roll of the web down toward the serrated strip 170 with its serrations 140, then closes the top wall 118 and the section 114 of the side wall down to the position shown in FIG. 12 with the edge of the web sticking out, as shown by the dotted lines in FIG. 12. After pulling the web out further to the desired length, the web may be torn off against the serrations 140 of the strip 170. The panels 121, 122, 123, 124, 125, 126 function in the same way as the corresponding panels 21, 22, 23, 24, 25, 26 of FIGS. 1 to 6. The additional extensions which cooperate in forming an end wall comprise extensions 190, 191 from the top wall 118 and 193, 192 from the reentrant double wall section 181. These two are folded in and utilized to hold the web or roll of sheet material in place.

The essential similarity between the two structures of FIGS. 1 to 6 on the one hand and 9 to 13 on the other is that the carton is reinforced by the extensions 160, 161 of the plastic strip 170 extending on to the end wall panels 125, 126. This reinforcement is located at the two points of possible tearing of the carton during use. During the pulling out of the web, the strain on the serrated strip during cut-off is transmitted from the bottom wall to the end walls. The utilization of the extension of the serrated strip onto the end walls serves to further integrate the bottom wall and the end walls and to reinforce the carton at the two points of maximum stress at either end of the carton.

In FIGS. 14 through 18, there is shown another modified form of the carton of FIGS. 1 to 6 and 9 to 13 having the tear-off strip 270, which corresponds to the tear-off strips 170 in FIGS. 9 to 13 and 70 of FIGS. 1 to 6. The tear-off strip 70 is located on the bottom wall of the carton and the bottom wall is specifically reinforced by a double fold of the material carrying the tear-off strip 270 with the serrations 240. In this case, the carton consists of the bottom wall 213 hingedly connected to the side wall which is, in turn, hingedly connected along the fold line to the top wall 218 and this, in turn, is hingedly connected by a fold line to the opposite side wall 214. The side wall 214 is provided with the opening strip 284 which will provide access to the carton in the manner shown in FIGS. 15 through 18. The opening strip is defined by a pair of tear lines 286 and 285 and is so arranged that the user may readily remove the strip 284, separating it from the remainder of the carton along the tear lines 285, 286. The tear line 285 also constitutes a hinged line along which the panel **214*a* may be folded against the section of the bottom wall 213 adjacent the wall 214 and the opening strip 284** and secured thereto.

The panel **214*a* is hingedly connected to the additional panel 214*b* which may be folded forward into surface-to-surface relation with the panel 214*a* and secured thereto in the manner shown in FIGS. 17 and 18. The serrated plastic strip 270 with the serrations 240, is adhesively secured to the outer surface of panel 214*b* projecting very slightly beyond the juncture of the bottom wall 213 with the principal side wall 214. It will thus be seen that the tear-off strip 270 is reinforced in its connection with the carton by being secured to the outermost of three layers of board at the area of securement, thereby providing an ample reinforcing structure for the tear-off strip so that it may resist the stresses imposed thereon when the web is torn off across the tear-off strip 270**.

In use, the user may remove the opening strip 284 by tearing it along parallel lines 285, 286 to release the wall 214 and hence the top wall 218 from its connection with the remainder of the carton. After this release has occurred, then the top wall 218 may be swung open from the position shown in FIG. 15 to the position shown in FIG. 16. The end of the web may then be pulled out and down toward the bottom wall and the cover may be closed to the position shown in FIG. 18 with the end of the web sticking out. The web may now be drawn by pulling on the free end thereof to the desired length whereupon it may be torn off against the plastic strip 270 and its serrated edge 240.

In the structure shown in FIGS. 9 to 13, the entire carton may be completed so that all of the elements are interconnected except the flap 182 which, in the final structure, is adhesively connected to the bottom wall. The carton is in that case in open condition with the entire side wall 114 lifted up with the top wall 118 and the panel 181 and the tab 182 extending therefrom.

(However, the section 180 has been folded back and adhesively secured as previously described.)

The roll or web is laid in and the carton is then sealed by applying appropriate adhesive and causing the flap 182 to be secured to the bottom wall 113. For this purpose of loading the web into the carton, the bottom wall may be treated as the lid which is open and then sealed. It should be noted that the carton, once sealed, remains impervious to any contamination or contact until the strip 184 is removed to permit the carton to be opened, as shown in FIGS. 10 and 11. This same method of loading will apply to the structure of FIGS. 14 and 15, wherein the carton may be left unsealed at any desired point to permit the insertion of a web. One of the preferred places where such insertion can occur is prior to the securement of the panels 214*a*, 214*b* to the bottom wall, thereby permitting the bottom wall to be open for laying in of the web.

The three forms of carton herein disclosed follow substantially the same principle wherein either the plastic serrated cutting member is utilized as the reinforcement for the carton itself by being extended to the end walls to assist in reinforcing the carton or the plastic tear-off cutting member is mounted in such a manner as to provide multiple layers of support for the carton at one wall. In each case, the blank may be made by the method shown in FIGS. 3 to 6 in which a single wide plastic strip may be secured to two blanks on a double blank and then the double blank cut apart by a serrated cutting knife which not only cuts the blanks apart, but also forms the serrated cutting edge. It should be noted that in each case, the plastic strip is secured to a free edge of the blank so that this method of forming the blank and cutting strip may be utilized for each of the three forms herein disclosed.

In the foregoing, the present invention has been described in connection with the preferred illustrative embodiments thereof. Since many variations and modifications of the present invention will now be obvious to those skilled in the art, it is preferred that the scope of the present invention be determined not by the specific disclosures herein contained but only by the appended claims.

What is claimed is:

1. A generally rectangular carton formed from a single blank of paperboard material, said carton for storing and dispensing a roll of sheet material, said carton comprising:

substantially identical rectangular top and bottom walls disposed in parallel relationship, said top and bottom walls each having first and second opposed side edges and opposed end edges;

substantially identical rectangular first and second side walls disposed in parallel relationship, said first and second side walls each having first and second opposed side edges and opposed end edges, said side edges of said first and second side walls and said side edges of said top and bottom walls being of equal length, said first side edges of said first and second side walls being foldably connected to the first side edges of said top and bottom walls respectively, said second side edges of said first and second side walls being foldably connected respectively to said second side edges of said top and bottom walls, at least a portion of said first side wall and the portion of said bottom wall adjacent said first side wall being formed by a plurality of layers of said paperboard material secured together and disposed in face-to-face relationship;

first and second end walls foldably connected to and extending between said top, bottom and side wall end edges, at least a portion of said end walls being formed from a plurality of layers of said paperboard material secured together and disposed in face-to-face relationship; and a relatively stiff reinforcing strip having a serrated edge, said strip being affixed at least to the portion of the bottom wall adjacent said first side wall and being folded and secured in face-to-face relationship with at least a portion of both said end walls, said strip and said plurality of layers of said paperboard material in said first side wall, said bottom wall and said end walls cooperating to reinforce said carton and to prevent warping, distortion or tearing of said carton.

2. A carton as in claim 1 wherein an opening strip is defined in said first side wall adjacent the portion thereof formed by a plurality of layers of said paperboard material.

3. A carton as in claim 2 wherein said top wall and portions of said end walls and said first side wall define a lid that is rotatable about the foldable connection between said top and second side walls, whereby when said opening strip on said first side wall is removed, said lid may be rotated about the foldable connection between said top and second side walls to provide access to said roll of sheet material stored in said carton.

4. A carton as in claim 3 wherein said reinforcing strip is a plastic strip adhered to said paperboard material.

5. A carton as in claim 1 wherein the portion of said bottom wall adjacent said first side wall defines a serrated edge, the serrated edges of said bottom wall and said reinforcing strip being substantially identical and in register with one another.

6. A carton as in claim 1 wherein each said end wall includes an end flap foldably connected respectively to the opposed end edges of said bottom wall, at least a portion of said reinforcing strip being secured to said end flaps to reinforce said carton.

* * * * *